US008135321B2

(12) United States Patent
Ruiz et al.

(10) Patent No.: US 8,135,321 B2
(45) Date of Patent: Mar. 13, 2012

(54) GAS KNIFE APPARATUS AND METHODS FOR STRIPPING MEDIA FROM SURFACE IN PRINTING APPARATUS

(75) Inventors: Erwin Ruiz, Rochester, NY (US); Charles Scott Kneisel, Farmington, NY (US); David Lalley, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 442 days.

(21) Appl. No.: 12/394,315

(22) Filed: Feb. 27, 2009

(65) Prior Publication Data

US 2010/0221046 A1 Sep. 2, 2010

(51) Int. Cl.
*G03G 15/20* (2006.01)

(52) U.S. Cl. ..... 399/323

(58) Field of Classification Search ..... 399/323, 399/322, 45

See application file for complete search history.

(56) References Cited

U.S. PATENT DOCUMENTS 3,609,029 A * 9/1971 Egnaczak ..... 399/131
5,154,407 A * 10/1992 Shidara ..... 271/12
6,844,937 B2 1/2005 Dempsey et al.
2004/0120735 A1* 6/2004 Baba et al. ..... 399/323
2007/0147912 A1* 6/2007 Fujii ..... 399/323
2009/0087202 A1* 4/2009 Hurst et al. ..... 399/45

* cited by examiner

*Primary Examiner* — Quana M Grainger

(74) *Attorney, Agent, or Firm* — Ronald E. Prass, Jr.; Prass LLP

(57) ABSTRACT

Apparatuses useful for printing and methods of stripping media from surfaces in apparatuses useful for printing are provided. An exemplary embodiment of an apparatus useful for printing includes a first member including a first surface; a second member including a second surface forming a nip with the first surface; a gas source; a rotary valve including a gas inlet in fluid communication with the gas source, a gas outlet and a rotor including a gas passage; a gas knife in fluid communication with the gas outlet of the rotary valve, the gas knife being adapted to emit gas onto the second surface downstream from the nip; and a motor coupled to the rotor. The motor is operable to rotate the rotor to selectively position the rotary valve in at least a first open position in which the gas passage is in fluid communication with the gas inlet and gas outlet, gas is supplied from the rotary valve to the gas knife which emits the gas having a first pressure onto the second surface, and a closed position in which the gas passage is not in fluid communication with the gas inlet and gas outlet and gas is not supplied from the rotary valve to the gas knife.

22 Claims, 6 Drawing Sheets

GAS KNIFE APPARATUS AND METHODS FOR STRIPPING MEDIA FROM SURFACE IN PRINTING APPARATUS

BACKGROUND

Some printing apparatuses include a nip formed by opposed members. In such apparatuses, media are fed to the nip where the members treat the marking material to form images on the media.

In such printing apparatuses, media can be stripped from one of the members using a gas flow. It would be desirable to provide apparatuses useful for printing and methods that can strip media from surfaces efficiently using a gas flow.

SUMMARY

Apparatuses useful for printing and methods of stripping media from surfaces in apparatuses useful for printing are provided. An exemplary embodiment of an apparatus useful for printing comprises a first member including a first surface; a second member including a second surface forming a nip with the first surface; a gas source; a rotary valve including a gas inlet in fluid communication with the gas source, a gas outlet and a rotor including a gas passage; a gas knife in fluid communication with the gas outlet of the rotary valve, the gas knife being adapted to emit gas onto the second surface downstream from the nip; and a motor coupled to the rotor. The motor is operable to rotate the rotor to selectively position the rotary valve in at least a first open position in which the gas passage is in fluid communication with the gas inlet and gas outlet, gas is supplied from the rotary valve to the gas knife which emits the gas having a first pressure onto the second surface, and a closed position in which the gas passage is not in fluid communication with the gas inlet and gas outlet and gas is not supplied from the rotary valve to the gas knife.

DRAWINGS

DETAILED DESCRIPTION

Figure 1:
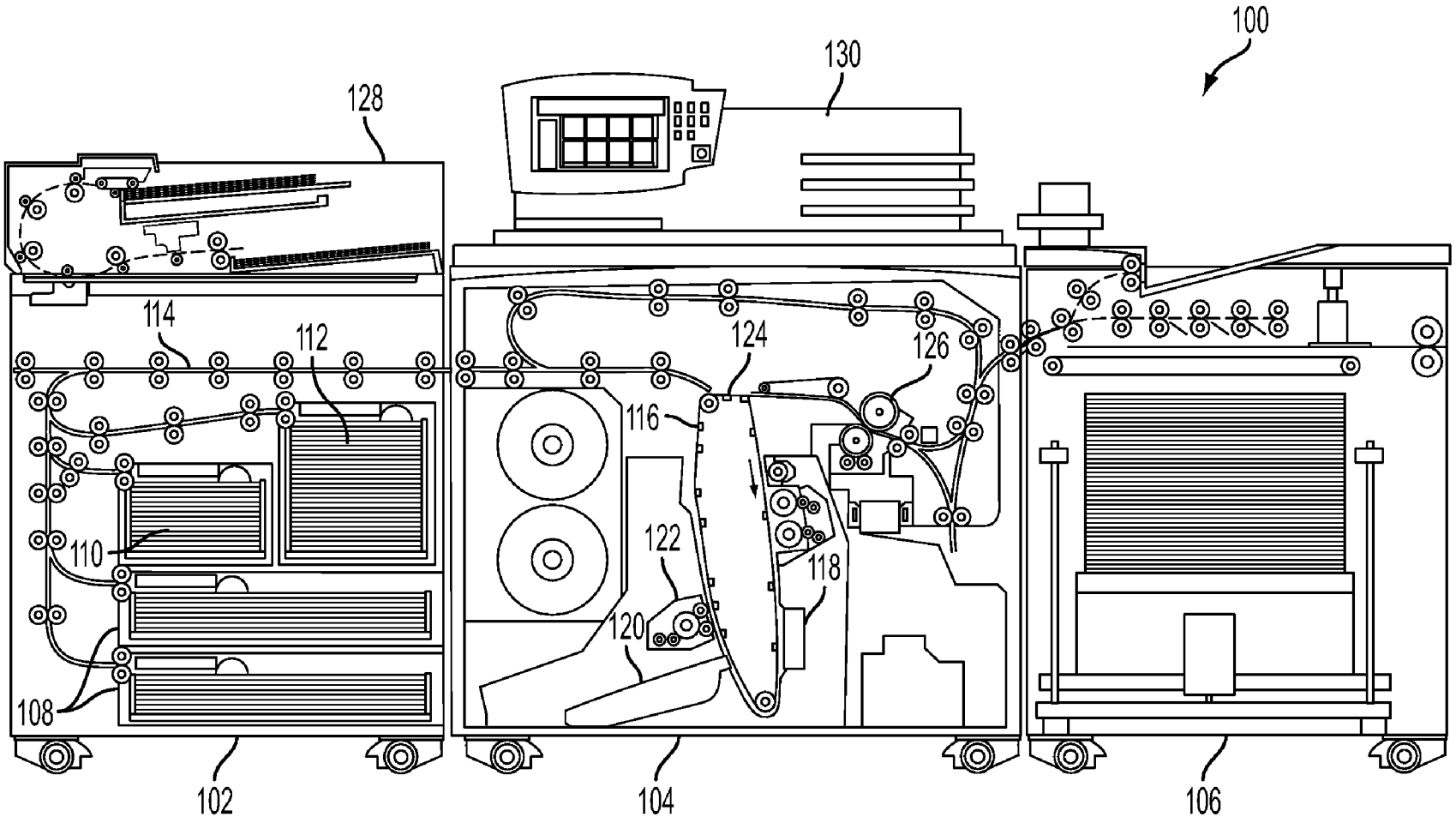
FIG. 1 depicts an exemplary embodiment of a printing apparatus.

The disclosed embodiments include an apparatus useful for printing. The apparatus comprises a first member including a first surface; a second member including a second surface forming a nip with the first surface; a gas source; a rotary valve including a gas inlet in fluid communication with the gas source, a gas outlet and a rotor including a gas passage; a gas knife in fluid communication with the gas outlet of the rotary valve, the gas knife being adapted to emit gas onto the second surface downstream from the nip; and a motor coupled to the rotor. The motor is operable to rotate the rotor to selectively position the rotary valve in at least a first open position in which the gas passage is in fluid communication with the gas inlet and gas outlet, gas is supplied from the rotary valve to the gas knife which emits the gas having a first pressure onto the second surface, and a closed position in which the gas passage is not in fluid communication with the gas inlet and gas outlet and gas is not supplied from the rotary valve to the gas knife.

The disclosed embodiments further include an apparatus useful for printing comprising a first member including a first surface; a second member including a second surface forming a nip with the first surface; a gas source; a flow control valve in fluid communication with the gas source; a gas knife in fluid communication with the flow control valve, the gas knife being adapted to emit gas onto the second surface downstream from the nip; and a controller. The controller is operable to control the control valve (i) to supply gas to the gas knife wherein the gas knife emits the gas having a first pressure onto the second surface, (ii) to supply gas to the gas knife wherein the gas knife emits the gas having a second pressure lower than the first pressure onto the second surface, and (iii) to stop the supply of the gas from the flow control valve to the gas knife.

The disclosed embodiments further include a method of stripping media from a surface in an apparatus useful for printing. The apparatus comprises a first member including a first surface, and a second member including a second surface forming a nip with the first surface. The method comprises feeding a first medium to the nip; supplying a gas from a gas source to a flow control valve in fluid communication with the gas source and with a gas knife; supplying the gas from the flow control valve to the gas knife which emits the gas having a first pressure onto the second surface of the second member downstream from the nip to strip the first medium from the second surface; and supplying the gas from the flow control valve to the gas knife which emits the gas having a second pressure lower than the first pressure onto the second surface downstream from the nip to prevent a portion of the first medium that has been stripped from the second surface from re-contacting the second surface.

As used herein, the term "printing apparatus" encompasses any apparatus, such as a digital copier, bookmaking machine, multifunction machine, and the like, that performs a print outputting function for any purpose. The printing apparatuses can use various types of solid and liquid marking materials, and various process conditions to treat the marking material and form images on media.

FIG. 1 illustrates an exemplary printing apparatus 100 disclosed in U.S. Pat. No. 6,844,937, which is incorporated herein by reference in its entirety. The printing apparatus 100 can be used to produce prints with different media types (sizes, weights, coated and uncoated, and the like).

The printing apparatus 100 includes a feeder module 102, a marking apparatus 104 adjacent the feeder module 102, and a finisher module 106 adjacent the marking apparatus 104. The feeder module 102 contains stacks of media 108, 110, 112 supported on trays. As shown, the media in stacks 108 have the same size, while the media in stacks 110 and 112 have different sizes.

Media fed from the stacks 108, 110, 112 are advanced to the marking apparatus 104 via a paper path 114. The marking apparatus 104 includes a rotatable image receptor adapted to temporarily retain at least one image for printing. The image receptor can comprise, e.g., a photoreceptor (drum or belt), or an intermediate transfer member. In the illustrated marking apparatus 104, the photoreceptor is a belt 116 supported by rollers. In the illustrated embodiment, a charging station 118, imaging station 120, development station 122 and transfer station 124 are positioned around the belt 116 to form images on a surface of the belt 116. The imaging station 120 can be, e.g., a laser-based rapid output scanner, or the like. The laser discharges areas on the moving belt 116 to form an electrostatic latent image. The image is developed at the development station 122 and transferred to a medium, e.g., a paper sheet, at the transfer station 124.

In the printing apparatus 100, the medium having received the developed image is then moved through a fuser 126. The fuser 126 applies heat and pressure to the medium to affix the toner image on the medium.

The printed medium is then moved to the finisher module 106, at which the medium can be collated, stapled, and the like.

Embodiments of the printing apparatus 100 are also operable as a copier. In such embodiments, a document feeder 128 converts an original hard-copy image into digital signals, which are processed to produce copies with the marking apparatus 104. The printing apparatus 100 also includes a user interface 130 for controlling operation of the printing apparatus 100.

Apparatuses useful for printing and methods of stripping media in apparatuses useful for printing are provided. Embodiments of the apparatuses are constructed to treat marking material that has been applied on media. The marking material can be toner, or various types of ink, in different embodiments of the apparatuses. Embodiments of the apparatuses are adapted to supply thermal energy and pressure to different types of media.

The apparatuses include opposed members that define a nip through which media are moved. In embodiments, both members are rolls. In other embodiments, one member is a roll and the other member is a belt. For example, one member can be an external pressure roll and the other member a belt provided on an internal pressure roll and forming the nip with the external pressure roll. In such embodiments, at least one of the internal and external pressure rolls can be heated to supply heat to media at the nip to treat marking material. Embodiments of the apparatuses are adapted to strip different types of media from one of the members after the media pass through the nip.

Figure 2:
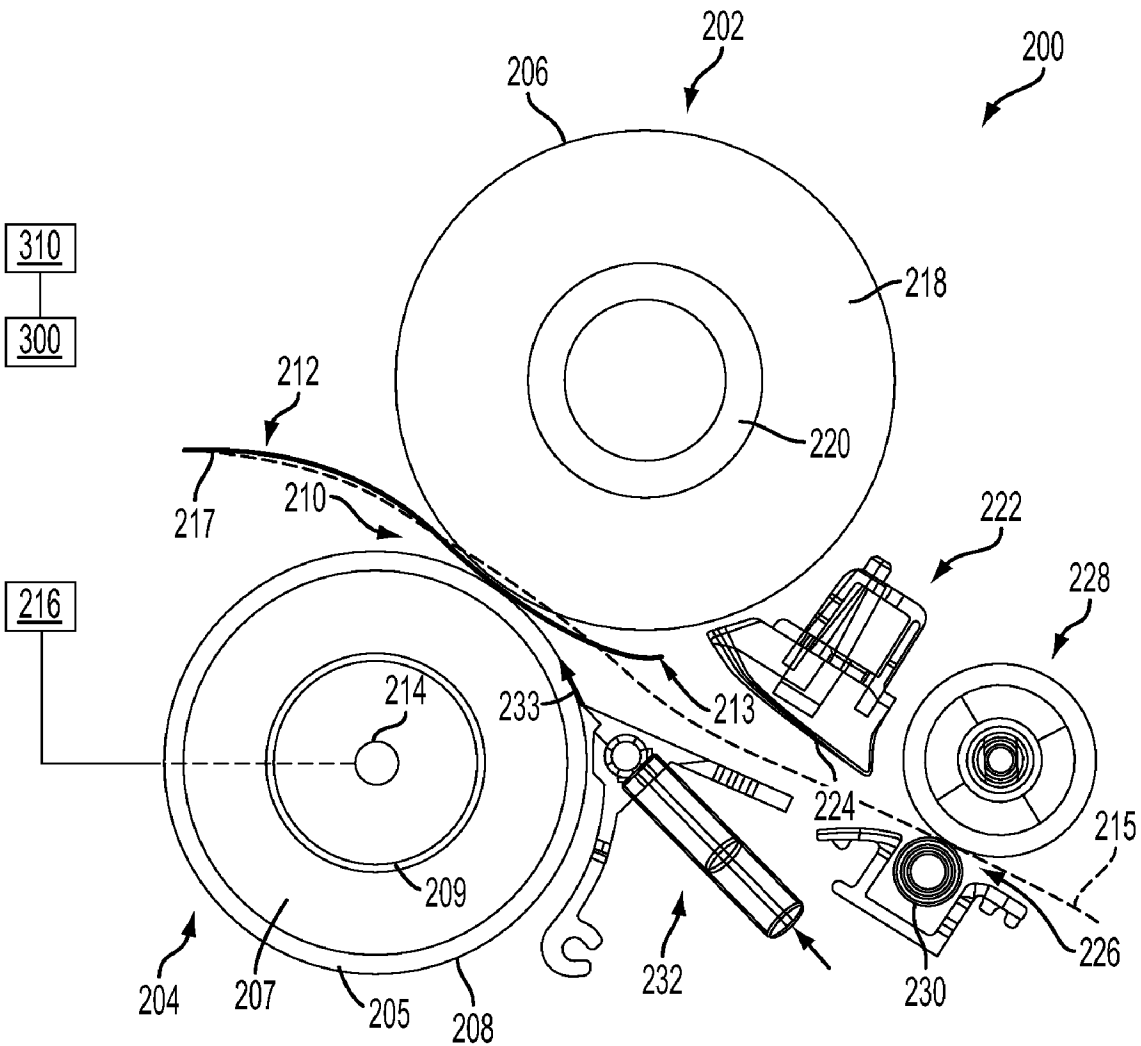
FIG. 2 depicts an exemplary embodiment of a fuser including a gas knife.

FIG. 2 illustrates an exemplary embodiment of an apparatus useful for printing. The apparatus is a fuser 200. The fuser 200 is constructed to facilitate stripping of different types of media that may be used in the fuser 200. Embodiments of the fuser 200 can be used with different types of printing apparatuses, such as with the printing apparatus 100 shown in FIG. 1 in place of the fuser 126.

The fuser 200 includes a pressure roll 202 and a fuser roll 204. In the illustrated embodiment, the pressure roll 202 is positioned above the fuser roll 204. In other embodiments, the fuser roll 204 can be positioned above the pressure roll 202. The pressure roll 202 includes an outer surface 206 and the fuser roll 204 includes an outer surface 208. The pressure roll 202 and fuser roll 204 forms a nip 210 between the outer surfaces 206, 208. A typical media path 215 for media fed to the nip 210 is indicated in FIG. 2. A medium 212 having a lead edge 213 and a bottom surface 217 is shown passing through the nip 210.

In the embodiment, the fuser roll 204 includes an internal heating element 214, such as at least one axially-extending lamp, connected to a power supply 216. In other embodiments, the fuser roll 204 can include more than one heating element. The heating element 214 is powered by the power supply 216 to heat the outer surface 208 to a sufficiently-high temperature to treat marking material on media fed to the nip 210, e.g., fuse marking material on the media.

In the embodiment, the pressure roll 202 includes an outer layer 218 including the outer surface 206. The outer layer 218 overlies a rigid core 220. In embodiments, the outer layer 218 can be comprised of an elastically deformable material, such as rubber or the like, that is deformed by engagement with the fuser roll 204 at the nip 210.

In the embodiment, the fuser roll 204 includes an outer layer 205, an intermediate layer 207, and a base layer or core 209. In an exemplary embodiment, the base layer is comprised of aluminum, or the like; the intermediate layer is comprised of silicone, or the like; and the outer layer is comprised of Teflon®, or other suitable polymeric material.

The fuser 200 further includes a guide member 222 having a contoured surface 224. The contoured surface 224 is configured to guide the medium 212 in the direction toward a nip 226 formed between the opposed rollers 228, 230.

The fuser 200 further includes a gas knife 232. The gas knife 232 is operable to direct a flow of a gas, as indicated by arrow 233, onto the outer surface 208 of the fuser roll 204, adjacent to the outlet end of the nip 210. The gas flow is effective to strip the medium 212 from the outer surface 208. The gas is typically air. Other suitable gases can also be used. The gas flow has a sufficient flow rate and pressure to mechanically separate (i.e., strip) media from the outer surface 208 after the lead edge of such media has passed through the nip 210. FIG. 2 shows the medium 212 after the lead edge 213 has been stripped from the outer surface 208 by the gas flow 233 emitted by the gas knife 232. In embodiments, the lead edge 213 of the medium 212 can be stripped close to the outlet of the nip 210, such as at about the 1 o'clock position of the fuser roll 204, to provide desirable image quality on media. In embodiments, the gas flow from the gas knife 232 is directed across the entire dimension of the media transverse to the process direction of the media through the nip 210.

The gas knife 232 can have any suitable construction that provides gas flow with the desired characteristics to the desired location in the fuser 200 for stripping media. In embodiments, the air knife 232 can have a rigid structure. For example, the air knife 232 can be an extrusion of aluminum, or the like. The structure includes an internal plenum in which gas accumulates to provide distributed air flow for multiple gas outlets (orifices) disposed along a direction oriented with respect to the process direction of media. The gas outlets are configured and oriented to provide gas flows directed in desired orientations to achieve stripping of media from the fuser roll 204 in different modes of operation. Typically, the gas outlets can provide a gas flow of about 0.25 cfm per outlet. Typically, the operating pressure can range from about 10 psi to about 20 psi.

Once the lead edge 213 of the medium 212 has been separated from the outer surface 208 of the fuser roll 204 by the gas flow 233 emitted by the gas knife 232, continued rotation of the pressure roll 202 (counter-clockwise) and fuser roll 204 (clockwise) pushes the medium 212 toward the guide member 222. The surface 224 of the guide member 222 guides the medium toward the nip 226, where the medium is engaged by the rolls 228, 230 and pulled through the nip 226.

In embodiments, it is desirable to continue to emit the gas flow 233 from the gas knife 232 onto the bottom surface 217 of the medium 212 that has been separated from the outer surface 208 of the fuser roll 204, in order to prevent the medium 212 from falling back onto the outer surface 208 of the fuser roll 204. Such re-contact, or "re-tacking," can produce image defects, such as mottle or gloss differential, on media.

Figure 3:
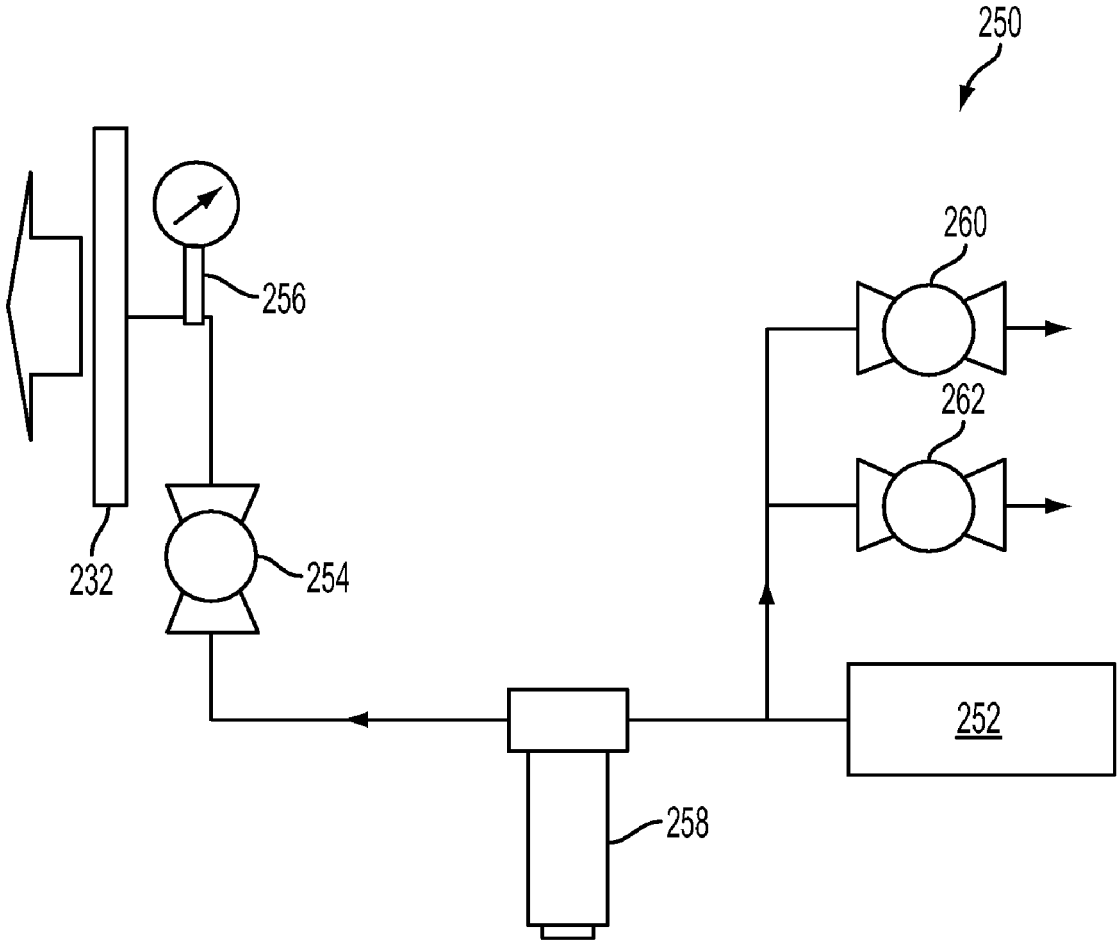
FIG. 3 depicts an exemplary embodiment of a gas supply system for supplying gas to a gas knife.

The fuser 200 further includes a gas supply system for supplying gas to the gas knife 232. FIG. 3 depicts a gas supply system 250 according to an exemplary embodiment. The gas supply 250 includes a gas source in fluid communication with the gas knife 232. In the embodiment, the gas source is a compressor 252. A flow control valve 254 is arranged in fluid communication with the compressor 252 and gas knife 232 to control the supply of gas to the gas knife 232. The flow control valve 254 can typically be located about 230 mm to about 250 mm from the gas knife 232.

An optional pressure sensor 256, such as a pressure transducer, is positioned to sense the gas pressure upstream of the inlet end of the gas knife 232. The pressure sensor 256 can typically be located about 150 mm to about 170 mm from the gas knife 232. The pressure sensor 256 can be used to sense the stripping pressure when the flow control valve 254 is open.

A gas dryer/filter 258 is located between the compressor 252 and flow control valve 254 to dry and filter the gas supplied to the gas knife 232. A pressure relief valve 260 and a bypass valve 262 are also included in the gas supply system 250. Gas flow directions in the gas supply system 250 are indicated by arrows in FIG. 3.

Figure 4:
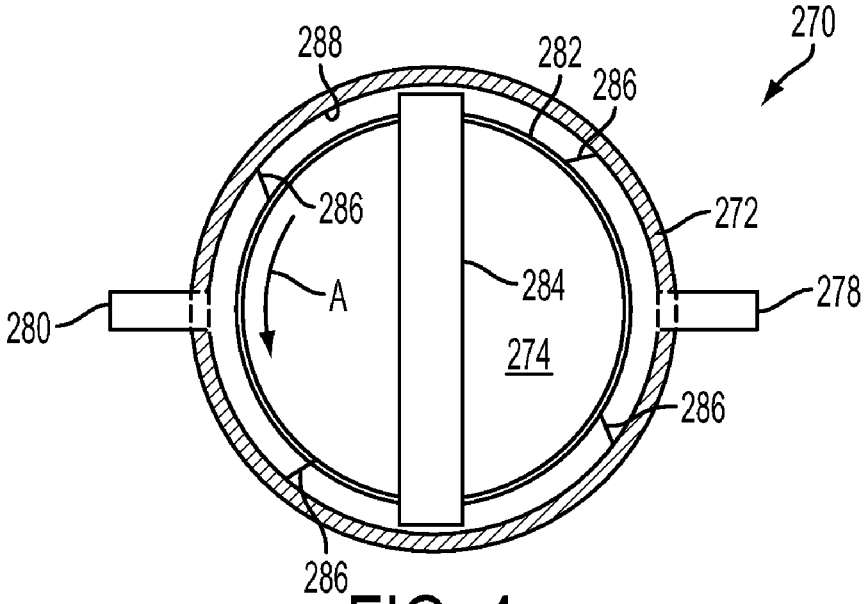
FIG. 4 is a cross-sectional view of an exemplary embodiment of a flow control valve.
Figure 5:
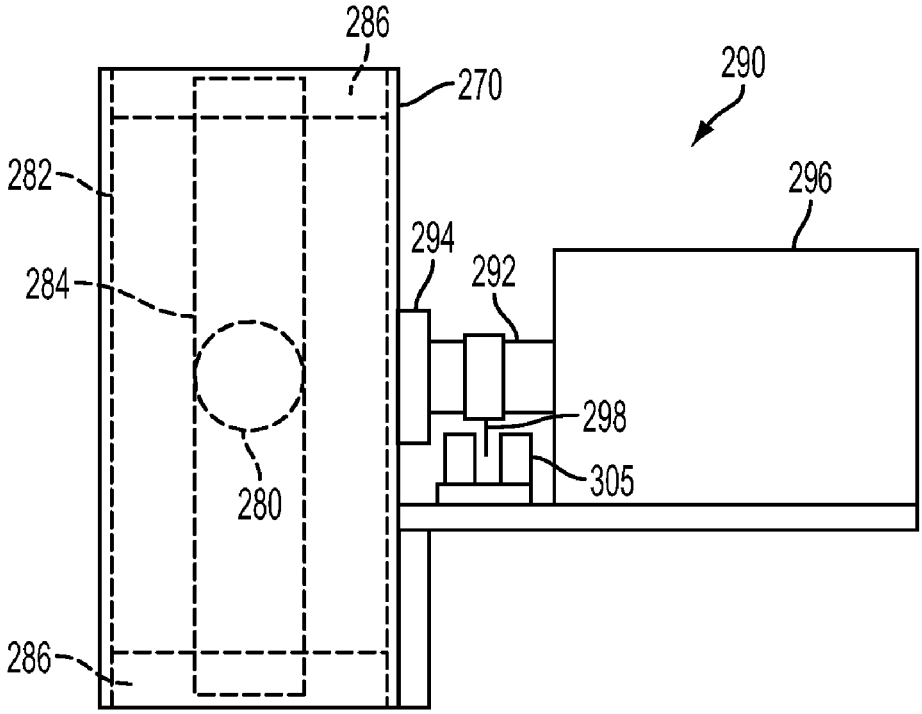
FIG. 5 shows the flow control valve of FIG. 4 connected to a drive mechanism.

In embodiments, the flow control valve 254 of the gas supply system 250 is a fast-response valve that can be rapidly opened and closed. FIGS. 4 and 5 depict a flow control valve 270 according to an exemplary embodiment. The flow control valve 270 is a rotary valve.

The flow control valve 270 includes a housing 272 defining an internal chamber 274. The chamber 274 can have a circular cross-section, as shown. In embodiments, the housing 272 is sealed and constructed to be able to contain a gas pressure of at least about 40 psi to allow pneumatic control within the operational range of about 10 psi to at least about 40 psi, for example. The housing 272 includes a gas inlet 278, where gas enters the housing 272, and a gas outlet 280, where gas exits from the housing 272. In embodiments, the gas inlet 278 and gas outlet 280 can be positioned about 180 degrees apart from each other about the circumference of the housing 272. The gas inlet 278 and gas outlet 280 can both have the same size and cross-sectional shape.

A rotor 282 is disposed inside the chamber 274 of the housing 272. The rotor 282 can have any suitable configuration, such as a disk or ball shape, depending on the configuration of the housing 272. A gas passage 284 extends through the rotor 282. For example, the gas passage 284 can be a drilled circular-shaped hole or a tube. In FIG. 4, the flow control valve 270 is shown in a closed position, in which the gas passage 284 is not in fluid communication with the gas inlet 278 and gas outlet 280, and gas is not supplied to the gas knife 232.

The flow control valve 270 provides multiple open positions. To place the flow control valve 270 in an open position, the rotor 282 can be rotated about 90° from the position shown in FIG. 4 in the counter-clockwise direction indicated by arrow A to position the gas passage 284 in fluid communication with the gas inlet 278 and gas outlet 280. When the flow control valve 270 is in an open position, gas can be supplied from the gas inlet 278 to the gas outlet 280 via the gas passage 284, and from the gas outlet 280 to the gas knife 232 along a portion of the gas line of the gas supply system 250.

In embodiments, the rotor 282 can be rotated to selectively position the gas passage 284 over a range of partially- to fully-aligned positions with the gas inlet 278 and gas outlet 280, i.e., in a range of partially-open positions to the fully-open position of the flow control valve 270, to vary the characteristics of the gas flow from the flow control valve 270 to the gas knife 232.

In embodiments, the rotor 282 is sealed to prevent gas leakage when the flow control valve 270 is closed. Flexible seals 286 are attached to the rotor 282 and rotate with the rotor 282 relative to the stationary housing 272. The seals 286 contact the inner surface 288 of the housing 272 to form a gas-tight seal to prevent gas from leaking from the gas inlet 278 to the gas outlet 280. In embodiments, an additional valve, such as a solenoid valve, can optionally be incorporated in the gas supply system to close off the supply of gas when the flow control valve 270 is closed.

As shown in FIG. 5, the rotor 282 is connected to a drive mechanism 290 for rotating the rotor 282 to control gas flow from the flow control valve 270 to the gas knife. In the illustrated embodiment, the drive mechanism 290 includes a rotatable shaft 292 connected to the rotor 282. In embodiments, the shaft 292 is mounted in bearings on opposed sides of the housing 272, with one bearing mounted in a blind/closed bore, and another bearing open to allow the shaft 292 to extend outside the housing 272. A seal 294 is fitted on the shaft 292 to prevent gas leakage.

The shaft 292 is coupled to a motor 296 operable to rotate the shaft 292 and attached rotor 282. The motor 296 can be, e.g., a stepper motor, or the like. A flag 298 is attached to the shaft 292 between the motor 296 and the seal 294. A sensor 305, such as an optical sensor, is operable to sense the angular position of the flag 298. In embodiments, the motor 296 can be operated to rotate the shaft 292 in desired angular increments (steps), e.g., equal 1.8 degree increments, which represents two hundred steps, or different positions, per full revolution of the shaft 292. The angular resolution for the rotation of the shaft 292 can be increased to provide smaller angular increments by micro stepping the motor 296. The sensor 305 and flag 298 provide a reference for the home position (e.g., closed or OFF position) of the flow control valve 270. In the home position, gas is not supplied to the gas outlet 280. The motor 296 can be returned to the home position before each actuation.

As shown in FIG. 2, the fuser 200 can include an optional media sensor 300 to sense media approaching the nip 210. The media sensor 300 is located upstream of the nip 210 and connected to a controller 310. In embodiments, the controller 310 is also connected to the motor 296. Once a medium approaching the nip 210 is sensed by the media sensor 300, the media sensor 300 sends a signal to the controller 310. In response to receiving the signal, the controller 310 controls the motor 296 to position the flow control valve 270 in an open position that supplies sufficient gas pressure to the gas knife 232 to cause the lead edge of the medium to be stripped from the outer surface 208 of the fuser roll 204. Typically, full (maximum) gas pressure is used to strip the lead edge of the medium from the outer surface 208. To supply full gas pressure from the flow control valve 270, the rotor 272 is moved to the stationary, fully-open position, in which the gas passage 272 is fully aligned with the gas inlet 278 and gas outlet 280.

In embodiments that do not include the media sensor 300, an operator can define the media prior to assembling the next print job. Software can be used to determine appropriate machine settings in the fuser 200 once the media type is identified.

Once the lead edge of the medium is stripped from the outer surface 208 of fuser roll 204, the gas pressure is reduced to a pressure that is sufficient to prevent re-tacking of the medium to the outer surface 208. In embodiments, this reduced gas pressure can be maintained at least until the lead edge of the medium is engaged by the rollers 228, 230 at the nip 226. The gas pressure can be reduced, and the reduced pressure can be supplied, according to various modes of operation of the flow control valve 270.

In a first mode of operation (Mode 1) of the flow control valve 270, once the lead edge of a medium has been stripped from the outer surface 208 of fuser roll 204, such as depicted in FIG. 2, the flow control valve 270 is partially closed by rotating the rotor 282 using the motor 296 to reduce the gas flow from the gas outlet 280 to a level that is sufficient to prevent re-tacking of the medium to the outer surface 208. When partially closed, the gas passage 296 is partially aligned with the gas inlet 278 and gas outlet 280. Once the medium passes through the nip 226, the motor 296 re-homes until another medium is sensed by the sensor 300. Mode 1 of operation provides a continuous gas flow from the flow control valve 270 to the gas knife 232 that is effective to strip media and prevent re-tacking of the media, while also conserving the pneumatic supply from the compressor 252 of the gas supply system 250.

Figure 6A:
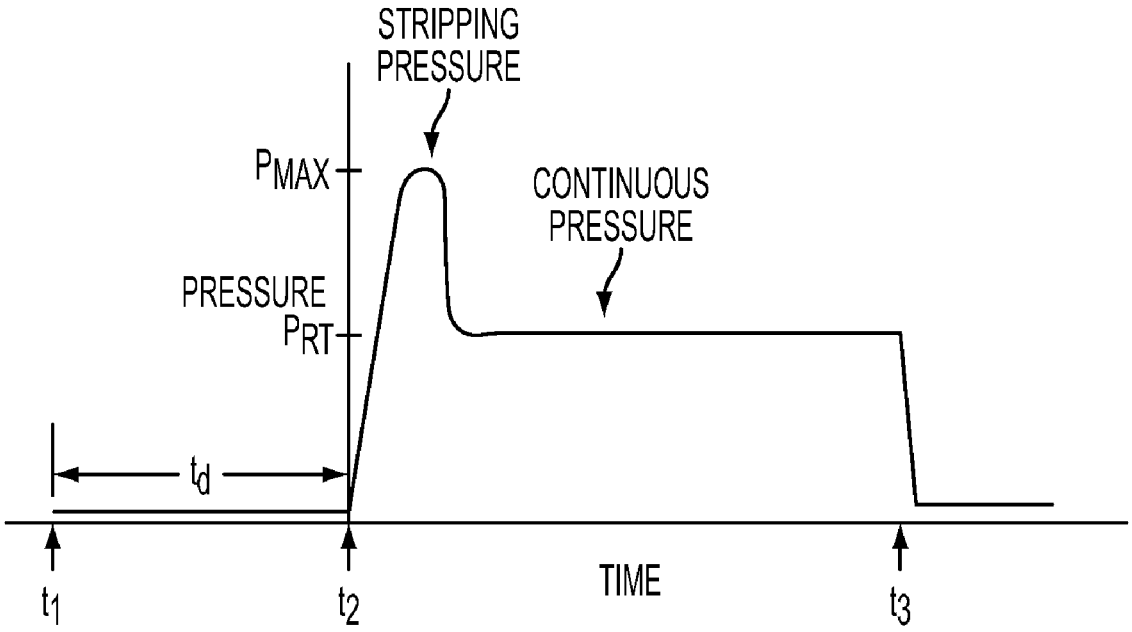
FIG. 6A shows a curve of gas pressure as a function of process time for gas emitted by a gas knife according to an exemplary mode of operation of the fuser of FIG. 2.

FIG. 6A depicts an exemplary curve of gas pressure versus time according to Mode 1. As shown, at a time, $t_1$, the lead edge of a medium is detected by the media sensor 300 (FIG. 2). After a time delay, $t_d$, at time, $t_2$, the gas pressure supplied by the flow control valve 270 is increased from zero (i.e., the rotary valve is closed) to a maximum pressure $P_{MAX}$ to strip the lead edge of the medium from the outer surface 208 of fuser roll 204. The time delay, $t_d$, can equal approximately the amount of time that it takes for the lead edge of the medium to advance from the location in the apparatus where the medium is sensed by the sensor 300 to the nip 210. For example, the maximum pressure $P_{MAX}$ can correspond to the fully-open position of the flow control valve 270. The maximum pressure $P_{MAX}$ is maintained for a specified period of time.

In Mode 1, the gas pressure is then reduced to a lower pressure, $P_{RT}$, which is sufficient to prevent the medium from re-tacking onto the fuser roll 204. The gas pressure value $P_{RT}$ results from decreasing the degree of alignment of the gas passage 296 with the gas inlet 278 and gas outlet 280 in the flow control valve 270. The pressure $P_{RT}$ can have a value of, e.g., about 0.6 to about 0.7 $P_{MAX}$. In embodiments, the reduced gas pressure $P_{RT}$ is continued to be supplied from the flow control valve 270 for a selected amount of time until time, $t_3$. In embodiments, time $t_3$ can correspond to a selected time period after the lead edge of the medium reaches the nip 226 and is engaged by the rollers 228, 230. As the process speed of the medium through the media path is increased, the amount of time that the pressure $P_{RT}$ is maintained (i.e., the time difference between times $t_3$ and $t_2$) can be decreased.

Figure 6B:
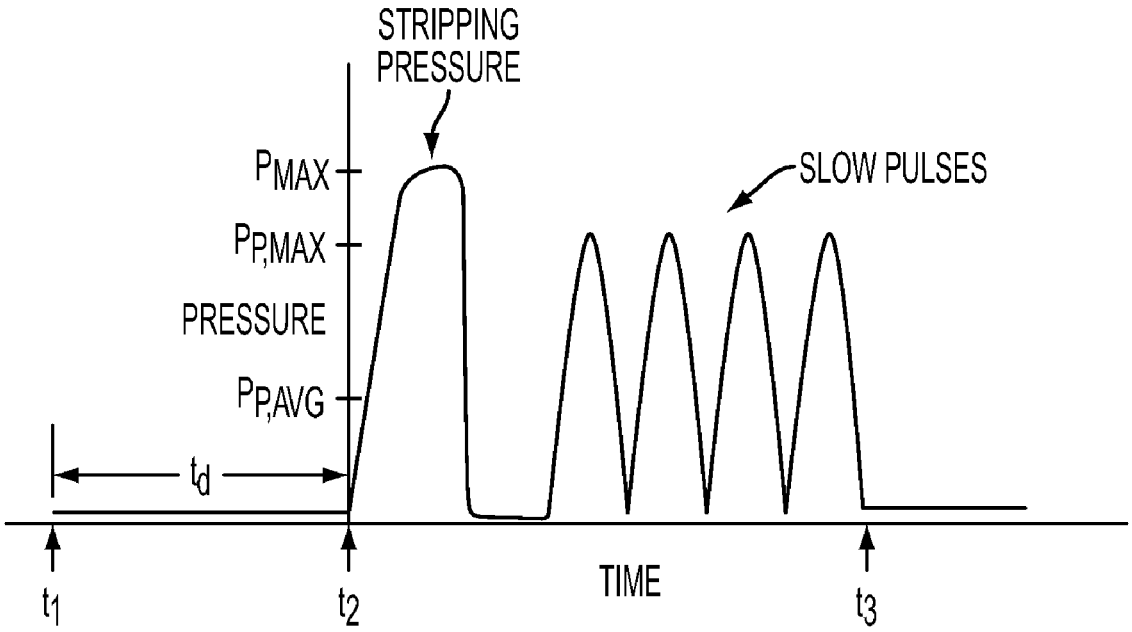
FIG. 6B shows a curve of gas pressure as a function of process time for gas emitted by a gas knife according to another exemplary mode of operation of the fuser of FIG. 2 where the gas flow is pulsed.

A second mode of operation (Mode 2) of the flow control valve 270 is depicted in FIG. 6B. In Mode 2, at a time, $t_1$, the lead edge of a medium is detected by the media sensor 300 (FIG. 2). After a time delay, $t_d$, at time, $t_2$, the gas pressure supplied by the flow control valve 270 is increased from zero to a maximum pressure, $P_{MAX}$, to strip the lead edge of a medium from the outer surface 208 of fuser roll 204. The maximum pressure $P_{MAX}$ is maintained for a specified period of time.

Then, the motor 296 is operated to continuously rotate the shaft 292 and attached rotor 282 at a selected speed to repeatedly pulse the gas flow supplied by the flow control valve 270 to the gas knife 232. The illustrated gas pressure pulses are "slow pulses." As shown, the gas pressure pulses have a peak value, $P_{P,MAX}$, and an average value, $P_{P,AVG}$. The peak values, $P_{P,MAX}$, of the gas pressure for the pulses occur as a result of the rotor 282 of the flow control valve 270 rotating through the fully-open position. The pressure $P_{P,MAX}$ can have a value of, e.g., about 0.7 to about 0.8 $P_{MAX}$. As shown, for each pulse, the gas pressure falls to about zero. The zero pressure values of the pulses result from the rotor 282 rotating through the closed position in which the gas passage 284 is not in fluid communication with the gas inlet 278 and gas outlet 280 and gas flow to the gas knife 232 is stopped. Pressure in the gas supply system 250 is recharged when the flow control valve 270 is closed during rotation of the rotor 282. The gas pressure pulses are effective to prevent re-tacking of the medium to the outer surface 208. In embodiments, the gas pressure pulses are continued until time, $t_3$. In embodiments, time $t_3$ can correspond to a selected amount of time after the lead edge of the medium reaches the nip 226 and is engaged by the rollers 228, 230

Mode 2 of operation of the flow control valve 270 may conserve more pressure in the gas supply system 250 than Mode 1 as a result of the rate of repeatedly opening and closing the flow control valve 270 used in Mode 2. This pulsing generates an instantaneous back pressure in the gas supply system 250 to limit the pressure drop during stripping. Pulsing of the gas flow does not require a continuous flow, which can create streaks due to localized cooling of the outer surface 208 of the fuser roll 204. By reducing the amount of time that gas flow is supplied to the outer surface 208, cooling of the outer surface 208 can be reduced. Consequently, the fuser roll 204 can be heated with lower power consumption.

By such pulsing of the gas flow, an increased operating pressure can be produced for the same size (i.e., amount of gas) of gas supply system. By conserving pneumatic pressure, the gas pressure supplied by the flow control valve 270 can be maintained at optimal standards for stripping media without occurrences of re-tacking and associated image defects. By controlling the pressure more efficiently, overworking of the compressor 252 of the gas supply system 250 can be avoided, extending the reliability and service life of the compressor 252.

In embodiments, the maximum value, minimum value, average value, and/or frequency of the gas pressure pulses emitted by the gas knife 232 can be varied by controlling operation of the motor 296 to control the flow control valve 270. The position of the shaft 292 can be controlled to control the amount of gas flow provided from the flow control valve 270, and the speed of the motor 296 can be varied to adjust the pulse duration and frequency. Pulse duration is a function of the configuration of the flow control valve 270 and the rotational speed of motor 296.

Figure 6C:
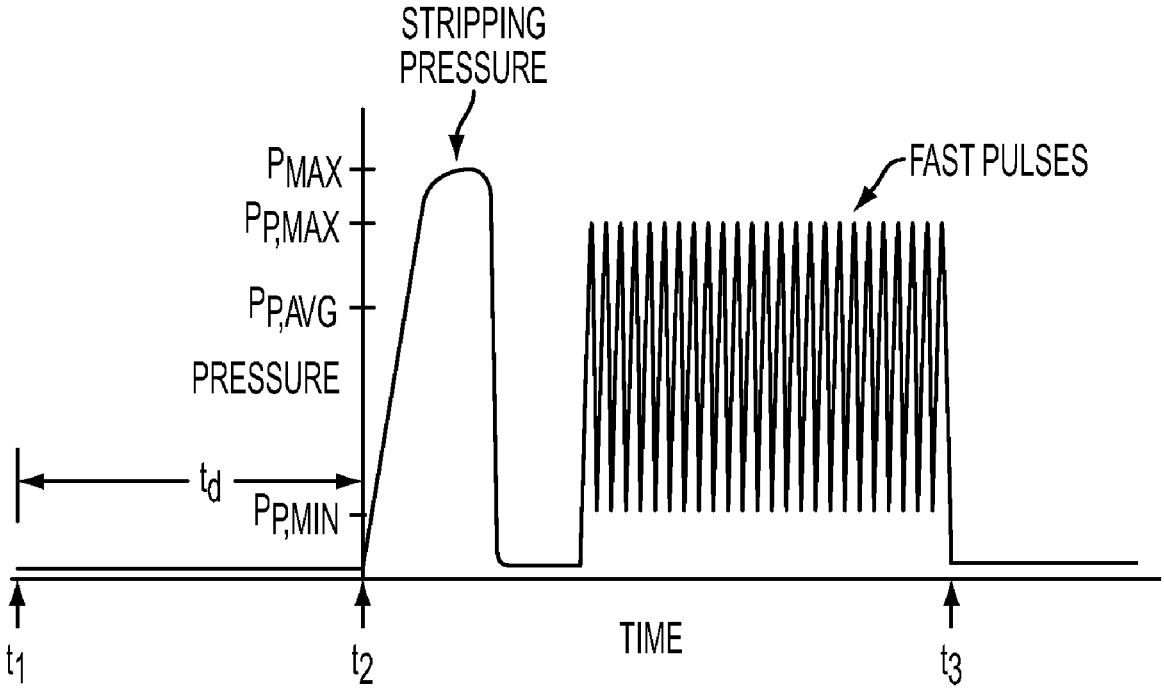
FIG. 6C shows a curve of gas pressure as a function of process time for gas emitted by a gas knife according to another exemplary mode of operation of the fuser of FIG. 2 where the gas flow is pulsed at a higher frequency.

FIG. 6C depicts an exemplary third mode of operation (Mode 3) of the flow control valve 270 that produces different pulse characteristics than Mode 2. In Mode 3, at time, $t_1$, the lead edge of a medium is detected by the media sensor 300 (FIG. 2). After a time delay, $t_d$, at time, $t_2$, the gas pressure supplied by the flow control valve 270 is increased from zero to a maximum pressure, $P_{MAX}$, to strip the edge of a medium from the outer surface 208 of fuser roll 204. The maximum pressure $P_{MAX}$ is maintained for a specified period of time.

Then, the motor 296 is operated to continuously rotate the shaft 292 and attached rotor 282 at a desired speed to pulse the gas pressure supplied to the gas knife 232. The gas pressure pulses produced in Mode 3 have a higher frequency than the pulses produced in Mode 2 (FIG. 6B) and are "fast pulses." As shown in FIG. 6C, the gas pressure pulses produced in Mode 3 each have a peak value, $P_{P,MAX}$, an average value, $P_{P,AVG}$, and a minimum value $P_{P,MIN}$. The peak values, $P_{P,MAX}$, of the gas pressure for the pulses occur when the flow control valve 270 is rotated through the fully-open position. The pressure $P_{P,MAX}$ can have a value of, e.g., about 0.7 to about 0.8 $P_{MAX}$. The rotor 282 of the flow control valve 270 is rotated sufficiently fast to prevent the gas pressure pulses from falling to zero pressure, as in Mode 2, but to fall only to the minimum value $P_{P,MIN}$. The gas pressure pulses are effective to prevent re-tacking of the medium to the outer surface 208. In embodiments, the gas pressure pulses are continued until time, $t_3$. In embodiments, time $t_3$ can correspond to a selected amount of time after the lead edge of the medium reaches the nip 226 and is engaged by the rollers 228, 230.

In embodiments, the operation of the motor 296 is controlled with the controller 310. The different pressure values used in the different modes of operation of the flow control valve 270 and the algorithm for controlling operation of the motor 296 can be programmed to allow operation of the motor 296 to be automatically controlled. For example, for Mode 1 of operation, the time values $t_1$, $t_2$ and $t_d$, and the pressure values $P_{MAX}$ and $P_{RT}$ can be stored; and for Modes 2 and 3 of operation, the time values $t_1$, $t_2$ and $t_d$, and the pressure values $P_{P,MAX}$, $P_{P,AVG}$, and $P_{P,MIN}$ can be stored. In embodiments, these values and the control algorithm can be provided on software stored on a computer-readable medium, which is encoded with a data structure readable by a system computer to perform the algorithm; on hardware, such as a fuser controller board; or provided on another suitable storage device.

Accordingly, embodiments of the gas supply system 250 can be operated to strip media in apparatuses without re-tacking of the media, while also reducing the pressure drop, to thereby increase and maintain a higher initial pressure in the gas supply system 250. By maintaining a higher initial pressure in the gas supply system 250, a smaller compressor with lower energy consumption and overall system noise can be used. The gas supply system 250 can increase latitude in environments in which higher pressures are desired, such as high altitude environments.

In embodiments, different types of media can be stripped from the fuser roll 204 by operation of the gas supply system 250 and gas knife 232. The media can be paper sheets, transparencies, packaging materials, and the like. Typically, paper is classified by weight as either light-weight (weight of ≦about 75 gsm), medium-weight (weight of about 75 gsm to about 160 gsm), or heavy-weight (weight of ≧160 gsm). The media can be coated or uncoated. Generally, heavier media are less difficult to strip than lighter media and coated media. Accordingly, such heavier media can be stripped from the outer surface 208 of the fuser roll 204 by using lower gas pressures from the gas knife 232.

In embodiments, the gas supply system 250 and gas knife 232 can have multiple gas pressure settings for stripping different media types efficiently. Light-weight media can be stripped by using fast pulses by lowering the gas pressure and emitting fast pulses to keep the media stripped without damaging the media. For heavy-weight media, which can be substantially self-stripping, low pressure can be used for stripping. Mode 1 depicted in FIG. 6 can be used for stripping coated media, for example.

Although the flow control valve of the gas supply system described above is a rotary valve, in other embodiments, the flow control valve can be a solenoid valve. Solenoid valves can provide a gas pressure effective to strip media from the fuser roll or belt, and the valves be rapidly pulsed to ON and OFF positions to produce pulsed gas flow from the gas knife to prevent re-tacking of media. In such embodiments, the solenoid valves can be controlled by a controller to produce the desired gas flow characteristics.

Although the above description is directed toward fuser apparatuses used in xerographic printing, it will be understood that the teachings and claims herein can be applied to any treatment of marking material on a medium. For example, the marking material can be toner, liquid or gel ink, and/or heat- or radiation-curable ink; and/or the medium can utilize certain process conditions, such as temperature, for successful printing. The process conditions, such as heat, pressure and other conditions that are desired for the treatment of ink on media in a given embodiment may be different from the conditions suitable for xerographic fusing.

It will be appreciated that various ones of the above-disclosed, as well as other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. An apparatus useful for printing, comprising:

a first member including a first surface;

a second member including a second surface forming a nip with the first surface;

a gas source;

a rotary valve including a gas inlet in fluid communication with the gas source, a gas outlet and a rotor including a gas passage;

a gas knife in fluid communication with the gas outlet of the rotary valve, the gas knife being adapted to emit gas onto the second surface downstream from the nip; and a motor coupled to the rotor;

wherein the motor is operable to rotate the rotor to selectively position the rotary valve in at least a first open position in which the gas passage is in fluid communication with the gas inlet and gas outlet, gas is supplied from the rotary valve to the gas knife which emits the gas having a first pressure onto the second surface, and a closed position in which the gas passage is not in fluid communication with the gas inlet and gas outlet and gas is not supplied from the rotary valve to the gas knife.

2. The apparatus of claim 1, wherein the motor is operable to rotate the rotor to selectively position the rotary valve in a second open position in which the gas passage is in fluid communication with the gas inlet and gas outlet, gas is supplied from the rotary valve to the gas knife which emits the gas having a second pressure lower than the first pressure onto the second surface.

3. The apparatus of claim 1, wherein the motor is operable to continuously rotate the rotor to repeatedly pulse the gas from the rotary valve to the gas knife.

4. The apparatus of claim 1, wherein the first member is a first roll and the second member is a heated second roll.

5. The apparatus of claim 1, further comprising a controller connected to the motor, wherein the controller controls the motor to selectively position the rotary valve in one of the first open position and closed position.

6. The apparatus of claim 5, further comprising a media sensor located upstream of the nip for sensing media approaching the nip, wherein the media sensor is connected to the controller and operable to send a signal to the controller when a medium is sensed, and the controller controls the motor in response to receiving the signal.

7. The apparatus of claim 1, further comprising a pressure sensor for sensing the pressure of the gas supplied from the rotary valve at a location upstream of the gas knife.

8. An apparatus useful for printing, comprising:

a first member including a first surface;

a second member including a second surface forming a nip with the first surface;

a gas source;

a flow control rotary valve in fluid communication with the gas source;

a gas knife in fluid communication with the flow control valve, the gas knife being adapted to emit gas onto the second surface downstream from the nip; and a controller operable to control the control valve (i) to supply gas to the gas knife wherein the gas knife emits the gas having a first pressure onto the second surface, (ii) to supply gas to the gas knife wherein the gas knife emits the gas having a second pressure lower than the first pressure onto the second surface, and (iii) to stop the supply of the gas from the flow control valve to the gas knife.

9. The apparatus of claim 8, wherein the first member is a first roll and the second member is a heated second roll.

10. The apparatus of claim 8, further comprising a motor connected to the controller and coupled to the flow control valve, wherein the controller controls the motor to selectively open the flow control rotary valve to supply the gas to the gas knife, and to close the flow control valve to stop the supply of the gas from the flow control valve to the gas knife.

11. The apparatus of claim 10, wherein the controller controls the motor to repeatedly open and close the flow control rotary valve to repeatedly pulse the gas from the flow control valve to the gas knife.

12. The apparatus of claim 8, further comprising a media sensor located upstream of the nip for sensing media approaching the nip, wherein the media sensor is connected to the controller and operable to send a signal to the controller when a medium is sensed, and the controller controls the flow control rotary valve in response to receiving the signal.

13. The apparatus of claim 8, further comprising a pressure sensor for sensing the pressure of the gas supplied from the flow control rotary valve at a location upstream of the gas knife.

14. A method of stripping media from a surface in an apparatus useful for printing, the apparatus comprising a first member including a first surface, and a second member including a second surface forming a nip with the first surface, the method comprising:

feeding a first medium to the nip;

supplying a gas from a gas source to a flow control rotary valve in fluid communication with the gas source and with a gas knife;

supplying the gas from the flow control rotary valve to the gas knife which emits the gas having a first pressure onto the second surface of the second member downstream from the nip to strip the first medium from the second surface; and supplying the gas from the flow control rotary valve to the gas knife which emits the gas having a second pressure lower than the first pressure onto the second surface downstream from the nip to prevent a portion of the first medium that has been stripped from the second surface from re-contacting the second surface.

15. The method of claim 14, wherein the gas is supplied from the flow control rotary valve to the gas knife to cause the gas knife to continuously emit the gas having the second pressure onto the second surface to prevent the portion of the first medium from re-contacting the second surface.

16. The method of claim 14, wherein the flow control rotary valve is repeatedly opened and closed to cause the gas knife to repeatedly emit pulses of the gas, which have a maximum pressure equal to the second pressure, to prevent the portion of the first medium from re-contacting the second surface.

17. The method of claim 16, further comprising varying at least one characteristic of the pulses.

18. The method of claim 14, further comprising:

sensing the first medium approaching the nip with a media sensor located upstream of the nip at a time, $t_1$;

sending a signal from media sensor to a controller when the first medium is sensed; and controlling the flow control rotary valve with the controller in response to receiving the signal.

19. The method of claim 14, further comprising:

controlling the flow control rotary valve with the controller to begin supplying the gas from the flow control rotary valve to the gas knife, at a time, $t_2$, after a time delay, $t_d$, from the time, $t_1$, to cause the gas knife to emit the gas having the first pressure onto the second surface of the second member downstream from the nip to strip the first medium from the second surface; and controlling the flow control rotary valve with the controller to stop supplying the gas to the gas knife, at a time $t_3$, to cause the gas knife to stop emitting the gas having the second pressure onto the second surface of the second member downstream from the nip.

20. The method of claim 14, further comprising:

feeding a second medium which is heavier than the first medium to the nip;

supplying the gas from the flow control rotary valve to the gas knife which emits the gas having a third pressure which is lower than the first pressure onto the second surface of the second member downstream from the nip to strip the second medium from the second surface; and supplying the gas from the flow control rotary valve to the gas knife which emits the gas having a fourth pressure lower than the third pressure onto the second surface downstream from the nip to prevent a portion of the second medium that has been stripped from the second surface from re-contacting the second surface.

21. The apparatus of claim 1, wherein the air knife comprises an internal plenum.

22. The apparatus of claim 1, wherein the air knife comprises an internal plenum, the internal plenum being configured to distribute air flow to an air knife orifice, the air knife orifice being configured to direct pressurized air flow.

* * * * *